United States Patent [19]

Raymond

[11] Patent Number: 4,494,382

[45] Date of Patent: Jan. 22, 1985

[54] METHOD AND APPARATUS FOR CONTROLLING WHEN TO INITIATE AN INCREASE IN COMPRESSOR CAPACITY

[75] Inventor: Glendon A. Raymond, Fulton, N.Y.

[73] Assignee: Carrier Corporation, Syracuse, N.Y.

[21] Appl. No.: 540,270

[22] Filed: Oct. 11, 1983

[51] Int. Cl.[3] ..... F25B 13/00

[52] U.S. Cl. ..... 62/160; 62/175; 62/228.5; 417/280

[58] Field of Search ..... 62/175, 160, 228.5, 62/228.4, 217; 236/1 EA; 417/45, 280

[56] References Cited

U.S. PATENT DOCUMENTS 3,513,662 5/1970 Golber ..... 236/1 EA
3,648,479 3/1972 Richardson ..... 417/45 X

FOREIGN PATENT DOCUMENTS 154384 11/1980 German Democratic Rep. ..... 417/280

*Primary Examiner*—William E. Wayner
*Attorney, Agent, or Firm*—Robert H. Kelly

[57] ABSTRACT

A method and apparatus for effecting capacity control of a compressor are described. The electric current to the compressor motor driving a variable step compressor is monitored. The subsequent operating current of the compressor is monitored and compared to the initial reference current value. Upon a predetermined variance between the reference current value and the current operating value being detected the capacity step of the compressor is increased to meet the additional load. Additionally there is provided other means for increasing the capacity step of the compressor including determining that an additional load on the refrigeration circuit has been energized and that the unit has been operating at a particular capacity step for a predetermined delay period. Means are disclosed for altering the capacity step of the compressor in response to any of the above occurrences indicating a need to increase the capacity step of the compressor.

14 Claims, 7 Drawing Figures

METHOD AND APPARATUS FOR CONTROLLING WHEN TO INITIATE AN INCREASE IN COMPRESSOR CAPACITY

BACKGROUND OF THE INVENTION

1. Field of the Invention

The present invention relates to refrigeration circuits. More specifically, the present invention concerns the utilization of the current to an electric motor driving a variable capacity compressor to determine when to increase the capacity of the compressor.

2. Prior Art

To effectively utilize an air conditioning system it is desirable to match the compressor output to the load on the system. Matching compressor output to the load on the system has been accomplished in many ways. One way is to operate the compressor motor at separate speeds thereby pumping separate amounts of refrigerant at each speed. Another way is to use valve unloaders and bypass means to limit the number of cylinders effectively pumping refrigerant within the compressor. A hot gas bypass wherein some of the discharge gas is circulated back to the compressor suction is another method of limiting compressor output. In centrifugal compressors, guide vanes are utilized to control the flow of refrigerant gas into the compressor to regulate the output by controlling the input.

The present invention is particularly concerned with a reciprocating type compressor capable of having varying refrigerant outputs in discrete stages. These outputs are controlled via unloader valves which effectively operate to render inoperative, in terms of pumping refrigerant, at least one of a pair of reciprocating pistons. To more effectively regulate the flow of refrigerant from the compressor, these individual pistons may be chosen to have varying displacements such that rendering one inoperative reduces refrigerant flow by a substantially different amount then rendering the other inoperative. Via this arrangement, a compressor having three capacity steps may be achieved by having two varying sized pistons. For a complete description of such a compressor and the control system therefor, please see U.S. patent application Ser. No. 479,044, entitled "Variable Volume Compressor And Method Of Operating", filed Mar. 25, 1983.

In split system air conditioning units, the compressor and condenser are typically located remote from the indoor heat exchanger. In such a system it would be advantageous, in terms of energy consumption, to have a multiple capacity compressor. In split systems having multiple indoor heat exchangers serviced by a single compressor and a single condenser, the advantages of utilizing a variable capacity compressor are further increased. Such a system might typically include three indoor heat exchangers connected to a single compressor and a single condenser. The number of operating stages of the compressor could be matched to the number of indoor heat exchangers such that the load on the system may be balanced simply by selecting the appropriate stage of the compressor for the number of heat exchangers being operated.

Such a system, however, is overly simplistic and, depending upon the various operating conditions of the separate indoor heat exchangers, may result in the compressor working too hard and wasting energy or being at a capacity stage which is sufficient to meet the load on just a partial number of indoor coils. For instance, should the outdoor ambient temperature be extremely high and only two indoor coils be calling for cooling (the third being shut down because the space is not being utilized) the compressor may need to operate in its highest capacity step as opposed to a lower capacity step to satisfy the load on just two indoor coils.

On the other hand, should the outdoor ambient temperature be relatively low and all three indoor fan coils are calling for cooling because of humidity conditions of the spaces being occupied, then the operation of the compressor at its highest capacity step may not be required to meet the cooling load.

The current device as disclosed herein utilizes capacity pressure sensors to determine when pressure levels have been reached. Specifically, a heating capacity pressure sensor is utilized and is connected to the compressor discharge line to sense the discharge pressure from the compressor. The heating capacity pressure sensor uses a switch arranged to move from a first state to a second state upon the pressure level being sensed exceeding a predetermined value. Hence, when the compressor discharge pressure exceeds the predetermined level of the heating capacity pressure sensor, the sensor changes from a first state to a second state indicating a need to reduce the compressor capacity. To reset the heating capacity pressure sensor, the sensor is subjected to low pressure to change the sensor from the second state back to the first state. The sensor is now in position to detect another variation above the preset pressure level. Between the heating capacity compressor sensor tripping and before the pressure sensor is again connected to sense the discharge pressure, the capacity of the compressor is reduced. As outlined in this herein application, a three state or three capacity step compressor is disclosed. If the compressor is operating at high capacity and the heating capacity pressure sensor indicates too much capacity- is present, the compressor will be cycled to the next lower or midlevel capacity.

A cooling capacity pressure sensor may also be utilized being set to trip upon the suction pressure to the compressor falling below a predetermined level. This sensor works similarly to the heating capacity pressure sensor in that upon the pressure falling below the predetermined level it changes from a first state to a second state. The capacity step at which the compressor is operated is decreased in response to the sensor tripping and the sensor is then reset by exposing the sensor to the relatively high discharge pressure from the compressor for a short interval.

In order to increase the capacity of the variable capacity compressor different means are used. One method is to monitor the value of the current being supplied to the compressor motor driving the compressor. After initialization, a current reference value is determined. Thereafter, at predetermined time intervals, the value of the current actually being drawn by the compressor is compared to the reference value. In the cooling mode of operation, should the value of the compressor current actually being monitored exceed the value of the reference current by a predetermined amount then it appears that an increase in capacity is required. The logic is provided to then increase the capacity step at which the compressor operates. In the heating mode of operation, the current comparison logic is similar. In this mode of operation, the value of the actual current is compared to the value of the reference current and whenever the actual current is a certain factor less than the value of the reference current and it is apparent that the capacity step of the compressor should be increased.

Additional means for increasing the capacity step of the compressor may also be provided. One such means would include automatically increasing the capacity step to the next step or to the maximum step upon the addition of any load to the refrigeration circuit. An additional load might be the energization of an additional heat exchanger of the three as set forth in this particular system.

Another method of determining when to increase the capacity step is to monitor the length of time the compressor continuously operates at a given capacity level. If this length of time should exceed a chosen set point then the compressor capacity could automatically be increased to the next level. A time period such as thirty minutes would be appropriate.

SUMMARY OF THE INVENTION

It is an object of the present invention to provide a refrigeration circuit incorporating a variable step compressor capacity control.

It is another object of the present invention to utilize the current draw of the motor driving a compressor for effecting capacity control of the compressor.

It is another object of the present invention to increase the capacity step of the compressor in response to the compressor current varying from a measured reference current level.

It is a still further object of the present invention to increase the capacity step of the compressor in response to the length of time the compressor operates at a particular capacity step.

It is yet another object of the present invention to increase the capacity of the compressor in response to additional loads being placed on the refrigeration system.

It is another object of the present invention to provide a safe, economical and reliable method of switching compressor capacity steps.

It is a further object of the present invention to provide a safe, economical and reliable, easy to install and manufacturable control for a variable step compressor.

Other objects will be apparent from the description and the appended claims.

The above objects are achieved according to the preferred embodiment of the invention by the provision of a control for a refrigeration circuit including an outdoor heat exchanger, at least one indoor heat exchanger and an electric motor driven variable capacity compressor. Current sensing means for sensing the current drawn by the motor driving the compressor are provided. In addition thereto logic means is connected to the current sensing means for storing the value of the current flow detected by the current sensing means as a reference value. Comparator means then compare the value of the current flow to the compressor motor after a delay interval to the value of the current flow stored in the logic means, said comparator means generating an increase signal when the selected one of said values exceeds the other of said values by a predetected factor. Means for increasing the capacity of the compressor in response to the detection of the increase signal are additionally provided. Additionally, logic means may be provided for multiplying the value of the current flow detected by the current sensing means by a variance factor such that the comparator means compares the value of the current flow to the compressor motor with the product of the current flow detected by the current sensing means and the variance factor. Additional steps for increasing the capacity of the compressor may be included such as generating an increase signal upon the lapse of a preselected delay interval during which the compressor motor is continuously energized and the capacity step of the compressor has not changed and generating an increase signal in response to an additional indoor heat exchanger being energized.

A method of determining when to increase the capacity of an electric motor driven variable capacity compressor of a refrigeration circuit having at least one indoor heat exchanger is additionally provided. The method includes the steps of sensing the steady state current draw of the compressor motor during operation of the refrigeration circuit as a reference value and determining the current draw of the compressor motor during subsequent operation of the refrigeration circuit. Thereafter, a signal is initiated to increase the capacity of the compressor motor when the step of determining ascertains the value of the current draw which varies from the reference value of the current drawn by a predetermined factor. Additionally, an initiation signal may be provided in response to monitoring the length of the time the compressor operates at a selected capacity step and generating a signal to increase the capacity of the compressor upon the step of monitoring determining continuous operation for a predetermined time period. Another manner for increasing the capacity of the compressor is to generate an initiation signal upon additional heat exchangers becoming active.

DESCRIPTION OF THE PREFERRED EMBODIMENT

The embodiment as described herein is adapted for use in a split system multi-evaporator unit having three indoor heat exchangers and a single condenser. It is contemplated that the three indoor heat exchangers would be mounted in separate rooms, that the condenser or outdoor heat exchanger would be mounted exterior of the space to be conditioned and that a third unit including the compressor and valves would be located in a separate enclosure. It is to be understood that this invention has like applicability to other types of air conditioning systems including those only having a single evaporator or indoor heat exchanger and those wherein the components are arranged in other configurations.

As used herein, reference is made to changing the capacity of the compressor between several states. It is further to be understood that although the specific compressor control arrangement disclosed incorporates three capacity states that this invention has like applicability to other numbers of capacity states and different valves for the capacity states as well as to continuously variable capacity compressors. It is further to be understood that this invention is not limited to the manner in which the capacity states are controlled such as by suction valve regulation, hot gas bypass, motor speed control, inlet guide vanes or other similar devices.

Additionally, the language herein will continually refer to a change in the pressure level acting to effect conditions detected by a pressure sensor. This change in pressure level may be either upwardly or downwardly and the language indicating a change in the pressure level or similar terms may be utilized both to include the discharge pressure level increasing as in heating to indicate a need for a capacity step reduction or the suction pressure decreasing as in cooling to indicate a need for a capacity step reduction.

Figure 1:
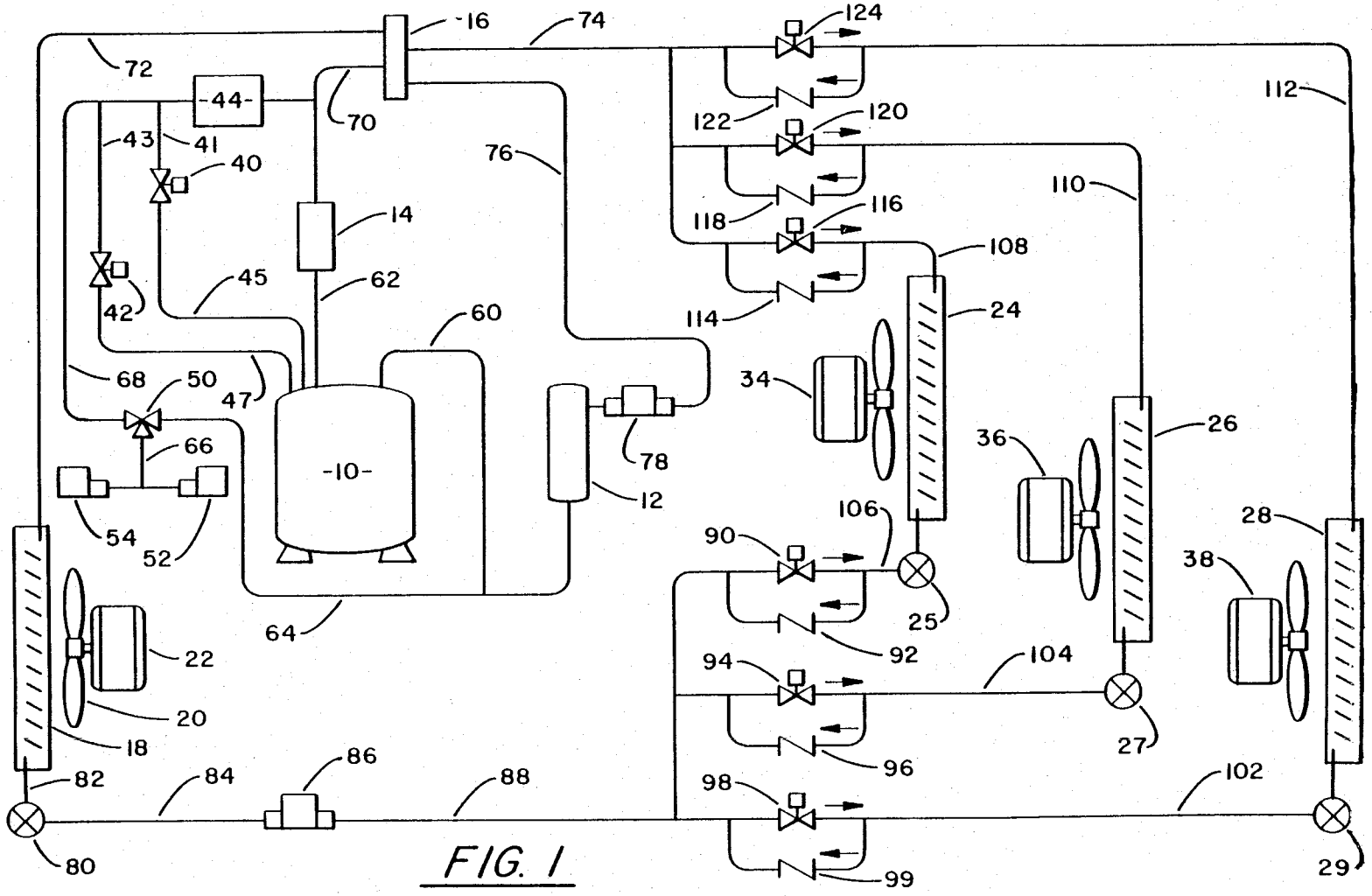
FIG. 1 is a schematic drawing of a refrigeration circuit.

Referring now to FIG. 1, there may be seen a schematic drawing of a refrigeration circuit. Compressor 10 is connected to discharge line 62 for discharging refrigerant at high pressure. The compressor receives refrigerant at low or suction pressure through suction line 60. Compressor discharge line 62 is connected to muffler 14 which is connected via conduit 70 to reversing valve 16 and to strainer 44. From strainer 44 via conduit 41 first unloader 40 is connected via conduit 45 back to the compressor. Additionally, from strainer 44 via conduit 43 second unloader 42 is connected via conduit 47 back to the compressor. When energized, the solenoid for each unloader valve opens the unloader supplying high pressure from the compressor discharge back to the unloader elements in the compressor to effectively unload one or the other of two compressor cylinders. Hence, if the first unloader is energized, the cylinder corresponding thereto is de-energized affecting the capacity of the compressor. The same applies to the second unloader which would act to de-energize the second cylinder in the compressor. Since the pistons within the compressor may be sized such that one alone acts to supply $\frac{1}{3}$ the capacity and the other portion supplies $\frac{2}{3}$ of the capacity, then by staging which unloader is energized the capacity levels of $\frac{1}{3}$, $\frac{2}{3}$ and full capacity may be obtained utilizing these two unloaders.

Conduit 72 connects reversing valve 16 to outdoor heat exchanger 18. Outdoor fan 20 connected to outdoor fan motor 22 acts to circulate air in heat exchange relation with refrigerant flowing through outdoor heat exchanger 18. Connected to outdoor heat exchanger 18 is conduit 82 which is connected to combination expansion device and check valve 80 and via conduit 84 to high pressure switch 86 and then to conduit 88. Conduit 88 is connected to liquid line solenoid 90, check valve 92, liquid line solenoid 94, check valve 96, liquid line solenoid 98 and check valve 99. Conduit 106 connects liquid line solenoid 90 and check valve 92 through expansion device 25 to indoor heat exchanger 24. Likewise, conduit 104 connects solenoid 94 and check valve 96 via expansion device 27 to indoor heat exchanger 26. Conduit 102 connects solenoid 98 and check valve 99 via expansion device 29 to indoor heat exchanger 28. Indoor fan motors 34, 36 and 38 are connected to indoor fans and act to circulate air through indoor heat exchangers 24, 26 and 28, respectively. Conduit 108 connects indoor heat exchanger 24 to suction line solenoid 116 and check valve 114. Conduit 110 connects indoor heat exchanger 26 to suction line solenoid 120 and check valve 118. Conduit 112 connects indoor heat exchanger 28 to suction line solenoid 124 and check valve 122.

Conduit 74 connects the reversing valve with suction solenoid valves 124, 120, 116 and to check valves 122, 118 and 114. Reversing valve 16 is also connected via conduit 76 through low pressure switch 78 to accumulator 12. Accumulator 12 is connected by suction line 60 to compressor 10.

The control portion of the refrigeration circuit for effecting capacity changes in the compressor includes high pressure conduit 68, low pressure conduit 64, sensing conduit 66, control valve 50 and heating capacity pressure sensor 54 and cooling capacity pressure sensor 52. Low pressure conduit 64 is connected between the compressor suction line 60 and control valve 50. High pressure suction conduit 68 is connected between strainer 44, connected to the compressor discharge line 62 through the muffler 14 and to control valve 50. Control valve 50 is connected to sensing conduit 66 which is connected to both the heating capacity pressure sensor and the cooling capacity pressure sensor.

Operation of The Refrigeration Circuit

In the cooling mode of operation, the compressor acts to discharge high temperature and pressure gaseous refrigerant through the discharge line, through reversing valve 16 and through condenser 18 wherein refrigerant changes state from a gas to a liquid. Liquid refrigerant is then cycled through the appropriate liquid line solenoids, 90, 94 and 98, to indoor heat exchangers 24, 26 and 28. Therein refrigerant evaporates changing state from a liquid to a gas absorbing heat energy from the air to be cooled. The gaseous refrigerant is then circulated through check valves 122, 118 and 114, back through reversing valve 16 to the accumulator and through the suction line to the compressor.

Control valve 50, may be a three-way valve formed from a pilot valve of a reversing valve with one of the four openings simply soldered shut to form a three-way valve. Control valve 50 in the cooling mode of operation acts to connect the low pressure from suction line 64 to the sensing conduit 66. The cooling capacity pressure sensor 52 then acts to determine whether or not the pressure in the suction line drops below a predetermined value. Should the pressure drop below such a value, then the cooling capacity pressure sensor will switch state from a second state to a first state. A control circuit will detect this switch in state and will then effect a change in the capacity of the compressor by changing the unloader valves 40 and 42. Assuming the compressor is operating in the high capacity stage, as it always operates when started up, then upon detecting this reduced pressure after a time interval, the cooling capacity pressure sensor will indicate the need to effect a change in the capacity compressor and the controls will act to energize first unloader valve 40 to reduce the capacity of the compressor to the mid-level capacity. The control valve 50 will remain in the same position during this time interval applying a low pressure level from the compressor suction line to the cooling capacity pressure sensor. Once the unloader valve is energized to change the capacity of the compressor the control valve is repositioned to the opposite position for a time interval such as 20 seconds such that high pressure from the compressor discharge line is supplied to the cooling capacity pressure sensor. This high pressure acts to reset the cooling capacity pressure sensor such that it changes state back to the second state from the first state. After this change period is over, the compressor operates in the midcapacity level and unless the cooling capacity pressure sensor again detects a drop in suction pressure below the preset level, will continue to operate. Should the additional drop in pressure below the preset level be detected then the cycle will begin again and the unloader valve 42 will be energized and unloader valve 40 will be de-energized such that the compressor is then operated in the low capacity state. The control valve will then be cycled for 20 seconds to the opposite position to provide high pressure to the cooling capacity pressure sensor to reset the cooling capacity pressure sensor to the first state.

In the heating mode of operation, the refrigeration circuit operates as a heat pump as is commonly known. The refrigerant flows through the indoor heat exchangers opposite the manner previously described in the cooling mode of operation. In this mode, reversing valve 16 is switched such that hot gaseous refrigerant from the compressor is directed first through solenoid valves 124, 120 and 116 and then to indoor heat exchangers 24, 26 and 28 where it is condensed from a gas to a liquid giving up its heat of condensation to the air to be heated. Liquid refrigerant then flows through check valves 92, 96 and 99 to the outdoor heat exchanger 18 now acting as an evaporator. From there refrigerant flows back through reversing valve 16 to the compressor suction line to the compressor.

In the heating mode of operation, the control valve is energized to be placed in the opposite position from the cooling mode of operation. In this mode of operation, the high pressure level from the discharge of the compressor is communicated with the heating capacity pressure sensor. Should the heating capacity pressure sensor detect an increase in this pressure level above a predetermined level then the heating capacity pressure sensor will change from the first state to the second state indicating a need to reduce the capacity of the compressor. In response to this indication, the unloader valve will be energized and the control valve will be repositioned for 20 seconds to apply low pressure from the compressor suction line to reset the heating capacity pressure sensor. This low pressure acts to reset the heating capacity pressure sensor from a second state to a first state such that upon continuation of refrigeration circuit operation an additional need to effect a further decrease in the heating capacity may be similarly detected.

Figure 2:
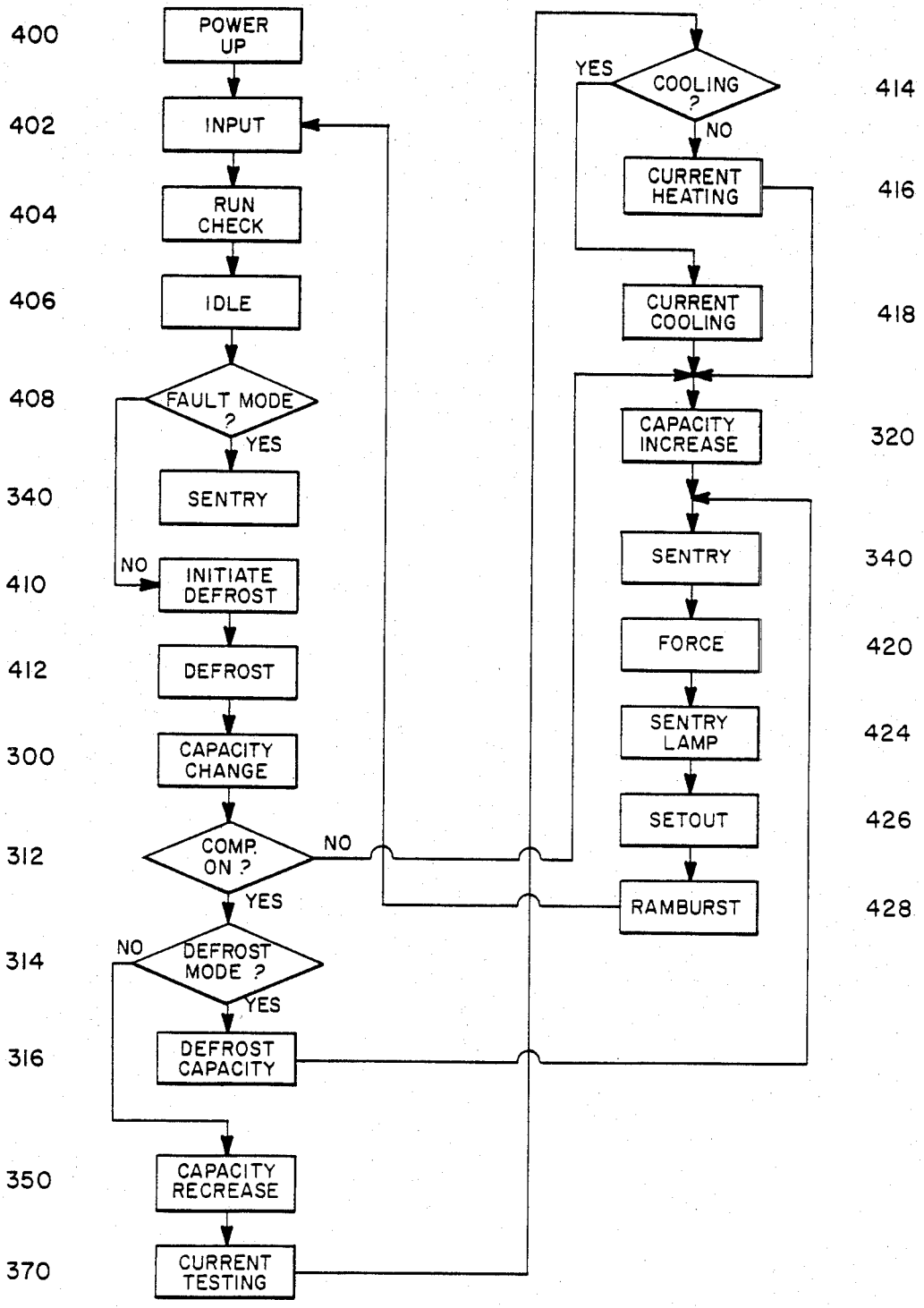
FIG. 2 is a flow chart outlining the overall logic of a microprocessor control regulating an air conditioning unit.

FIG. 2 is a flow chart indicating the overall operation of the control system. It can be seen that the overall system control is obtained by logic flow through a series of logic steps. Each logic step may represent a subroutine or a series of steps omitted for clarity in this overall chart. The initial step 400 is powerup of the unit upon energization. Thereafter, at step 402 the various inputs are sensed. To make sure the inputs are stabilized and debounced, a powerup delay occurs before proceeding to run check step 404. Step 406 places the control in the idle mode of operation. From there logic flows to determining whether or not the system is in a fault mode. If the answer to question in 408 is whether the system is in a fault mode is yes the logic then proceeds to step 340, known as the sentry step. This step may be seen additionally down toward the bottom of the flow chart and is an identical step. If the answer to whether or not a fault present in step 408 is no, the logic then proceeds to step 410 to initiate defrost.

Step 412 is the actual defrost operation. Upon completion thereof logic flows to the step of capacity change 300. At step 300 the logic flows to ask whether or not the compressor is energized. If the answer is no, the logic flows to step 320 for capacity increase. If the answer to the question at step 312 is yes, the logic flows to ask whether or not the unit is in the defrost mode of operation at step 314. If the answer to that question is yes, the unit moves into step 316, defrost capacity and from there to sentry step 340. If the answer to the question whether or not the unit is in the defrost mode at step 314 is no, the logic flows to step 350, capacity decrease. From capacity decrease the logic flows to step 370 for current testing. From there the logic flows to ask whether or not the unit is in the cooling mode of operation at step 414. If the answer to this question is no the logic flows to current heating step 416 and from there to capacity increase step 320. If the answer to the question at step 414 is yes, the logic flows from step 414 to the current cooling step 418. From there the logic flows to the capacity increase step 320. From capacity increase the logic flows to sentry step 340 and from there to force step 420, sentry lamp step 424, set out step 426, ram burst 428 and back to input 402. Hence, there is seen an outline of the overall logic flow of the operating control for this unit.

Figure 3:
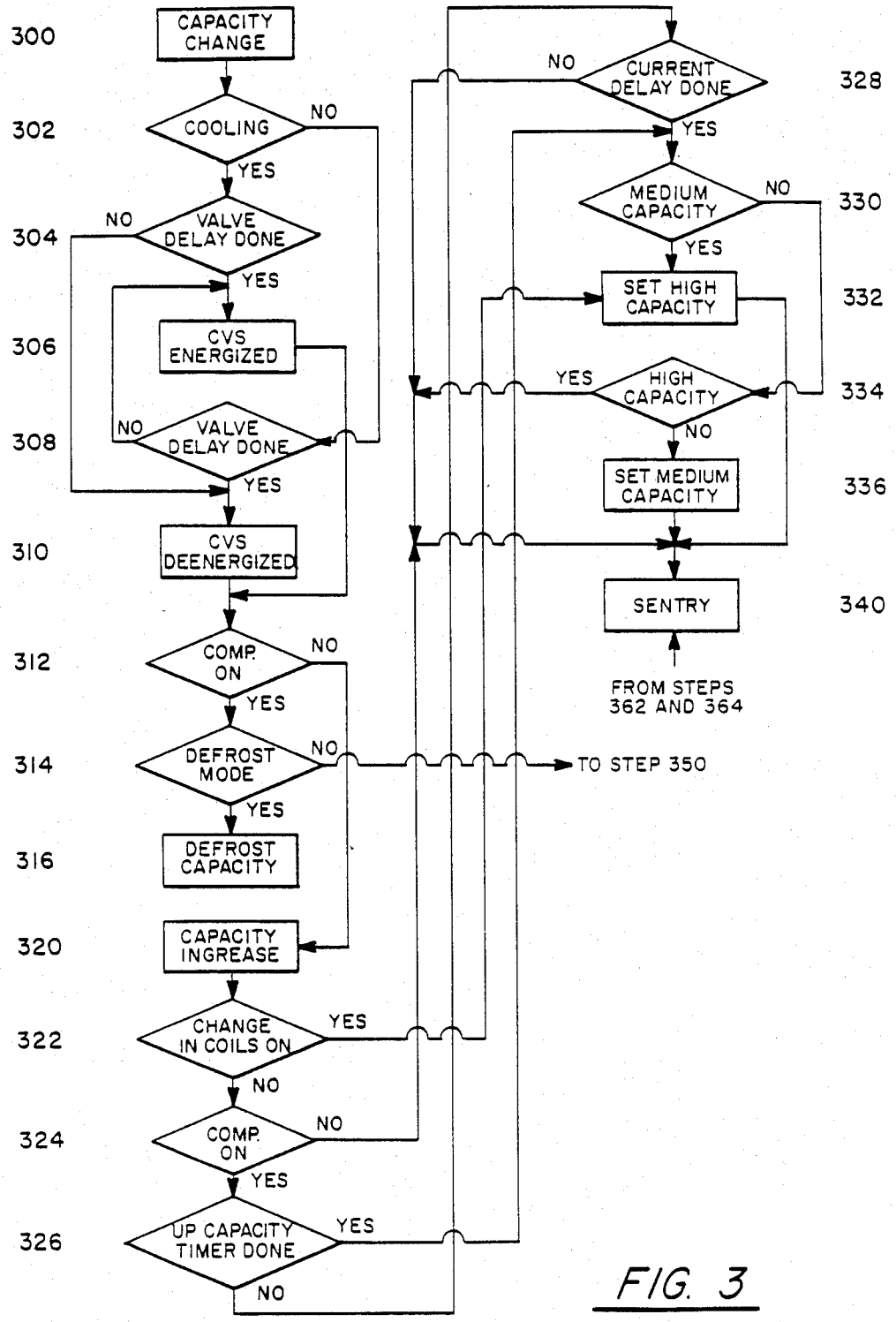
FIGS. 3 and 3A are flow charts of the capacity change subroutine including capacity increase and decrease portions of the microprocessor logic for controlling those functions.
Figure 3A:
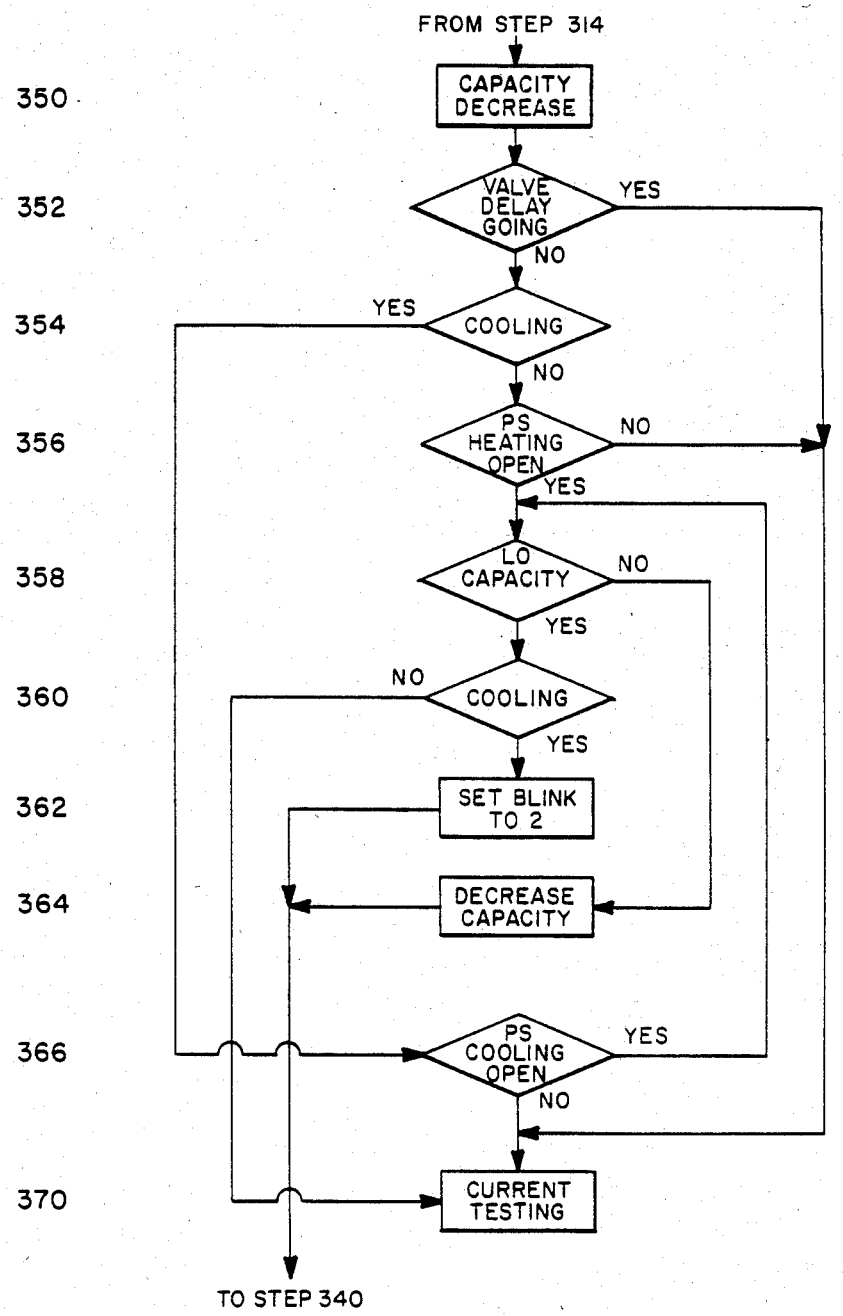

FIGS. 3 and 3A are flow charts detailing the capacity change logic in the control including capacity increase and capacity decrease. A portion of this logic has been shown in FIG. 2 in the overall flow chart.

Commencing at step 300, capacity change, the steps in FIG. 3 being labeled in numerical order such that they coincide with the steps labeled out of numerical order in FIG. 2. The logic flows from the step of capacity change 300 to step 302 to ask whether or not the unit is in the cooling mode of operation. If the answer to the question in step 302 is no the logic flows to step 308 to determine whether or not the control valve delay is done. The control valve corresponds to control valve 50 in the refrigeration circuit. The control valve delay is a delay period such as five minutes of continuous operation at a compressor capacity level before commencing pressure sensing. During this period the control valve is rendered inoperative and no pressure levels are sensed. If the control valve delay is done the logic then proceeds to the step of de-energizing the control valve step 310. This acts to place the control valve in position such that high pressure conduit 68 is connected to sensing conduit 66 for supplying high pressure to the heating capacity pressure sensor 54.

If the answer at step 302 as to whether or not the unit is in the cooling mode of operation is yes the logic flows to step 304 to ask if the control valve delay is done. If the answer to whether the control valve delay is done is no the logic flows to step 310 to maintain the control valve solenoid de-energized. If the answer to step 304 indicating the control valve delay is done and that the unit is in the cooling mode of operation the control valve solenoid is then energized at step 306 to place the low pressure conduit 64 in communication with the cooling capacity pressure sensor 52 via sensing conduit 66. Hence the portion of the logic described sofar asks to place the control valve in the appropriate position after the initial time delay is done to assure the appropriate pressure level is being sensed.

At step 312 the logic asks the question whether or not the compressor is operating. If the answer at this step is no the logic flows to step 320 to the capacity increase subroutine. If the answer at step 312 is yes the logic flows to step 314 to determine whether or not the unit is in the defrost mode of operation. If the answer at step 314 is yes the logic flows to defrost capacity step 316 as may be found in the flow chart in FIG. 2. If the answer to the question at step 314 whether or not the unit is in the defrost mode of operation is no the logic then flows to the capacity decrease subroutine labeled 350 and shown on FIG. 3A.

The capacity increase subroutine 320 includes the logic flowing to step 322 to ask whether or not there is a change in the number of coils on. This step means, has there been an additional indoor heat exchanger energized from the previous time that the question was asked. It is contemplated that each of the three indoor heat exchangers would have separate controls so that they may be manually energized at any time. If an additional heat exchanger has been energized and the answer to the question is yes, the logic flows to step 332 to set the compressor in high capacity. Hence, upon any increase in the number of heat exchangers being operated the compressor is automatically set at high capacity.

Should the answer to the question asked in step 322 be no, the logic flows to step 324 to ask whether or not the compressor is energized. If the compressor is energized the logic flows to step 326 to ask if the up capacity timer has timed out. The up capacity timer is a timer set to operate for approximately 30 minutes. If the unit has been operating for 30 minutes indicating a cooling or heating need for that period and has not satisfied that cooling or heating need then it is desirable to have the compressor automatically increase a capacity step. Hence, if the up capacity timer is done and the 30 minute time delay has lapsed then the logic flows from step 326 to step 330 to ask if the unit is in the medium capacity step. If the answer is yes the logic then flows to step 332 to set the unit in a high capacity step. If the answer is no the logic then flows to ask if the unit is in high capacity at step 334. If the answer to this question is yes the logic then flows to sentry step 340. If the answer is no indicating that the unit is neither in the medium capacity nor the high capacity then it is obvious that the unit is in the low capacity. Hence, the logic then flows to step 336 to set the unit in the medium capacity step. From the medium capacity step 336 the logic flows to sentry 340 and back to the overall flow chart as shown in FIG. 2.

If the answer to the question of whether or not the up capacity timer has elapsed at step 326 is no logic then flows to step 328 to ask whether or not the current delay is done. Step 328 indicates that the current value of the compressor motor is monitored after an initialization period. If the current of the compressor motor varies from the monitored amount a predetermined amount then it is desirable to increase the capacity of the compressor. Typical values for the step might be if the current of the compressor in the heating mode of operation falls below 87 ½% of the current when started then it is time to initiate increased capacity operation. In the cooling mode of operation should the current exceed the initialization current by more than 106.25% after a five minute delay period then it is likewise time to initiate a higher capacity step operation. In either of these events, if the answer to the question at step 328 is yes then the logic flows on to step 330 as previously described. If the answer at step 328 is no the logic then flows to sentry step 340.

The logic flows to capacity decrease subroutine 350 from step 314 when the compressor is on and the unit is not in the defrost mode of operation. The logic then flows to step 352 where the question is the valve delay going is asked. This valve delay is the delay when switching between capacity steps and may be for a period such as twenty seconds. If the answer to step 352 is yes the logic flows to step 370, current testing. If the answer to step 370 is no indicating no ongoing delay the logic then flows to step 354.

At step 354 the question of whether or not the unit is in the cooling mode of operation is asked. If the answer is no the logic flows to step 356 to ask whether or not the heating capacity pressure sensor is open. If the heating capacity pressure sensor is open indicating that the pressure level necessary to effect a reduction in the capacity of the compressor in the heating mode of operation has not been achieved then the logic flows to current testing step 370. If, on the other hand, the answer to the question in step 356 is yes the logic flows to step 358 wherein the question of whether or not the unit is operating in low capacity is asked. If the answer to this question is no the logic then flows to step 364 to decrease capacity and from there to sentry, step 340. If the answer is that the unit is already in the low capacity the logic flows to step 360 and if the unit is in the cooling mode of operation to step 362 to indicate a fault (set blink of a warning light) or if in the heating mode of operation onto current testing step 370.

If the answer to the question at step 354 is yes the logic flows to step 366 where the question of whether the cooling pressure sensor switch is open. If the switch is open the logic flows to logic step 358 to effect a capacity decrease. If the answer at step 366 is no the logic flows to step 370, current testing. The above has been a description of the operation of the logic within the microprocessor control of the system.

Figure 4:
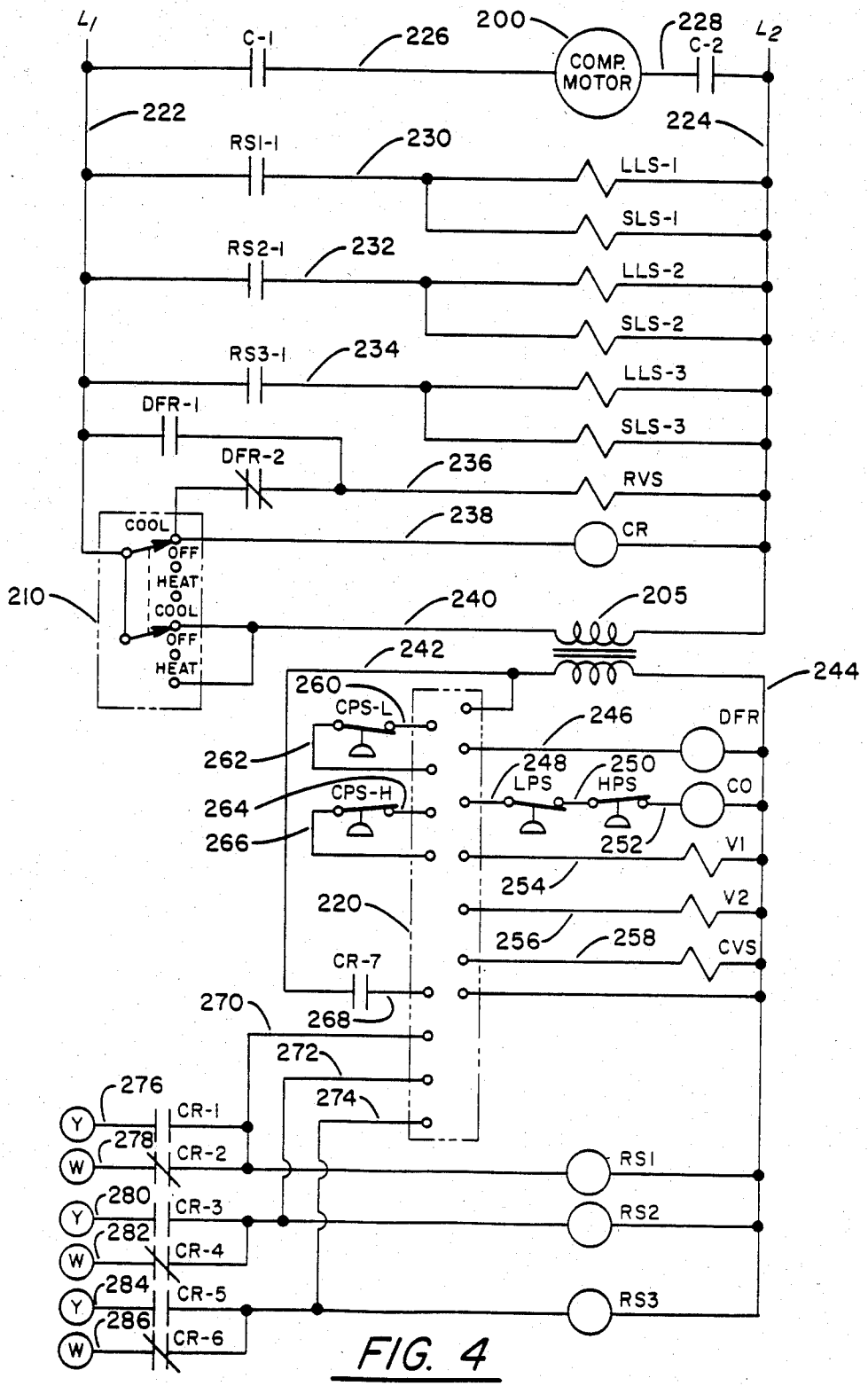
FIG. 4 is an electrical schematic diagram showing the interrelationships between the microprocessor and the various components of the refrigeration circuit.

FIG. 4 is an electrical schematic of a wiring diagram as may be used with a multiple indoor heat exchanger split system air conditioning unit in utilizing the control valve and pressure sensors as disclosed. Power is supplied to the wiring circuit through lines L1 and L2. Line L1 is connected by wire 222 to compressor contactor normally open contact C-1, to normally open refrigerant solenoid valve contacts RS1-1, to normally open refrigerant solenoid contacts RS2-1, to normally open refrigerant solenoid contacts RS3-1, to normally open defrost relay contacts DFR-1 and to master control 210. Line L2 is connected via wire 224 to normally open compressor relay contacts C-2, to the three liquid line solenoids LLS-1, LLS-2 and LLS-3; to the three suction line solenoid valves SLS-1, SLS-2 and SLS-3, to reversing valve solenoid RVS, to cooling relay CR and to transformer 205. Wire 226 connects normally open compressor contactor C-1 to compressor motor 200 of compressor 10 and which is connected by wire 228 to normally open compressor contacts C-2. Wire 230 connects normally open refrigerant solenoid contacts RS1-1 to liquid line solenoid LLS-1 and suction line solenoid SLS-1. Wire 232 connects normally open refrigerant solenoid contacts RS2-1 to liquid line solenoid contacts LLS-2 and suction line solenoid contacts SLS-2. Wire 234 connects normally open refrigerant solenoid contacts RS3-1 to liquid line solenoid LLS-3 and suction line solenoid SLS-3. Wire 236 connects normally open defrost relay contacts DFR-1 and normally closed defrost relay contacts DFR-2 to reversing valve solenoid RVS. Wire 238 connects master control 210, normally closed defrost relay contacts DFR-2 and cooling relay CR. Wire 240 connects master control 210 to the primary of transformer 205.

In the control wiring portion of the schematic the secondary of transformer 205 is connected to wire 244 and 242. Wire 244 is connected to defrost relay DFR, compressor relay C, first unloader solenoid V1, second unloader solenoid V2, control valve solenoid CVS to microprocessor 220 and to refrigerant solenoids RS1, RS2 and RS3.

Wire 242 is connected from the secondary of transformer 205 to microprocessor 220 and to normally open compressor relay contacts CR-7. The CR-7 normally open contacts are connected by wire 268 to microprocessor 220.

Wires 262 and 260 connect the cooling capacity pressure sensor CPS-L corresponding to pressure sensor 52 to microprocessor. Wires 264 and 266 connect the heating capacity pressure sensor CPS-H corresponding to pressure sensor 54 to microprocessor 220. Wire 246 connects the defrost relay to the microprocessor. Wire 248 connects the microprocessor to the low pressure switch which is connected by wire 250 to the high pressure switch which is connected by wire 252 to the compressor relay C. Wire 254 connects unloader solenoid V1 to the microprocessor. Wire 256 connects unloader solenoid V2 to the microprocessor. Wire 258 connects control valve solenoid CVS to microprocessor 220.

Connected to the thermostat wherein one of the indoor heat exchangers is located are wires 276 and 278, connected to the thermostat where another of the indoor heat exchangers are located are wires 280 and 282, and connected to the thermostat where a third indoor heat exchanger is located are wires 284 and 286. Wire 276 is connected to normally open cooling relay contacts CR-1 which is connected by wire 270 to the microprocessor and to refrigerant solenoid RS-1. Wire 278 is connected through normally closed cooling relay contacts CR-2 to wire 270.

Wire 280 is connected to normally open cooling relay contacts CR-3 which are connected by wire 272 to the microprocessor and to refrigerant solenoid RS2. Wire 282 connects to normally closed cooling relay contacts CR-4 to wire 272 and to refrigerant solenoid RS2. Wire 284 connects the normally open cooling relay contacts CR-5 which are connected by wire 274 to the microprocessor, to normally closed cooling relay contacts CR-6 and to refrigerant solenoid RS-3. Wire 286 connects to normally closed cooling relay contacts CR-6.

Operation—Control Circuit

When the master control is placed in the cooling mode of operation energy is supplied through normally closed defrost relay contacts DFR-2 to energize reversing valve solenoid RVS which energizes reversing valve 16 to place it in the appropriate position to direct refrigerant from the compressor to the outdoor heat exchanger. Additionally cooling relay CR is energized which acts to close contacts CR-7 indicating to the microprocessor that the cooling relay is energized. Additionally, cooling relay contacts CR-1, CR-3 and CR-5 all close connecting the wire indicating a cooling need from the respective indoor locations, wires 276, 280 and 284, to the appropriate refrigerant solenoids RS1, RS2 and RS3. Hence, should a demand occur at any of the thermostats a signal will be sent through these wires, and through these now closed cooling relay contacts to energize the appropriate refrigerant solenoids. Since the cooling relay contacts CR-2, CR-4 and CR-6 are normally closed, the energization of the cooling relay opens these contacts preventing a demand for heating as might flow along wires 278, 282 and 286 from energizing refrigerant solenoids RS1, RS2 or RS3. Once a refrigerant solenoid is energized, such as refrigerant solenoid RS1, the normally open refrigerant solenoid contacts RS1-1 close thereby energizing the liquid line solenoid and the suction line solenoid corresponding thereto referenced as LLS-1 and SLS-1. Hence, the solenoid valves to this refrigeration circuit are open such that refrigerant flows to the indoor heat exchanger corresponding thereto. The other two refrigerant solenoids operate in like manner to energize the appropriate liquid line and suction line solenoid valves (90, 94, 98, 116, 120, and 124).

When the unit is in the heating mode of operation the master control is placed in the heat position and the cooling relay is not energized. In this mode of operation the defrost relay, upon energization, will close defrost relay contacts DFR-1 energizing the reversing valve solenoid to place the unit in the cooling mode of operation to effect defrost. In the meantime, normally closed defrost relay contacts DFR-2 will open preventing energization of a cooling relay. The defrost relay is energized through the microprocessor.

With the master control in the heating mode of operation the cooling relay is not energized and the cooling relay contacts remain in the position as shown in the drawing. Hence, any call for cooling in wires 276, 280 or 284 is ignored and only calls for heating in wires 278, 282 and 286 act to energize the refrigerant solenoids RS1, RS2 and RS3. They, in like turn as in cooling, act to open the appropriate liquid line and suction line solenoids to allow refrigerant flow to the appropriate heat exchanger.

It can be additionally seen that the microprocessor is connected to control unloaders 40 and 42 of the refrigerant circuit through suction unloader solenoids V1 and V2 controlled through wires 254 and 256. Additionally, control valve 50 is controlled through the control valve solenoid CVS which is energized through wire 258.

Both the heating capacity pressure sensor and the cooling capacity pressure sensor are connected directly to the microprocessor such that a change in state in either one may be detected by the microprocessor to effect the appropriate logic as shown in the detailed logic flow charts accompanying herewith. The combination of the refrigerant circuit, the electric circuit and flow charts as disclosed herein all act to describe a multi-indoor heat exchanger refrigeration circuit wherein capacity steps of the compressor are changed by utilizing a single control valve to connect pressure sensors to high and low pressure. This single control valve acts to provide high pressure or low pressure to the various capacity pressure sensors to have the pressure sensor determine whether or not the pressure level is within a predetermined range or whether a capacity change is needed because the pressure level has exceeded that range. The control valve additionally acts to reset the pressure sensor by applying either a high or low pressure to the pressure sensor as needed to effect reset. Since the heating pressure sensor and the cooling pressure sensor operate in different pressure levels the operation of one will not affect the operation of the other and the pressure applied to one may be applied to both without any adverse impact.

Hence, a system for supplying multiple capacity step control utilizing but a single pressure sensor for heating and a single pressure sensor for cooling and a single control valve for supplying pressure to the pressure sensors and for supplying pressure to reset the pressure sensors has been described. A simple, reliable and effective system for effecting control has been detailed.

Figure 5:
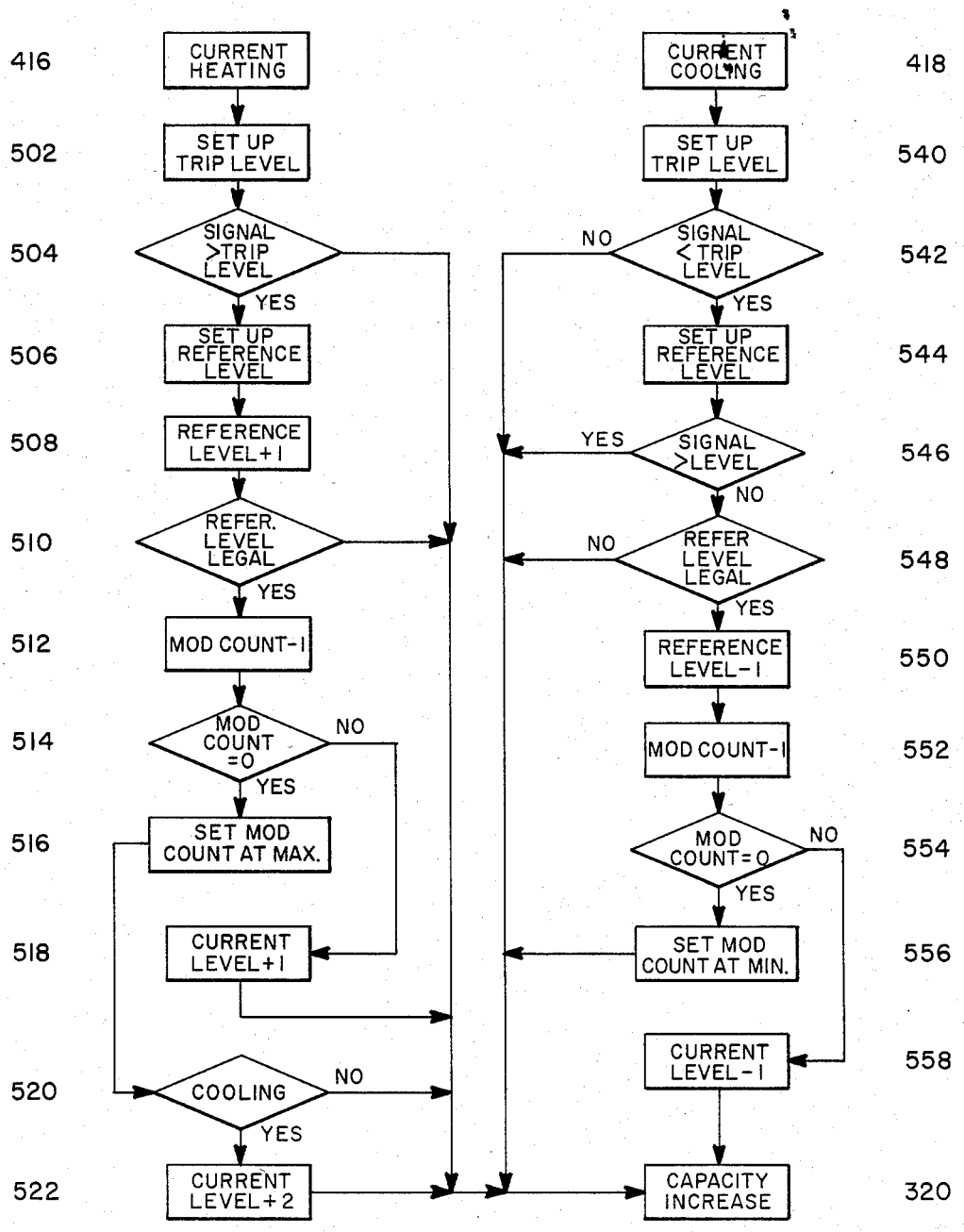
FIG. 5 is a flow chart of the current testing subroutine of the microprocessor logic.

FIG. 5 is a flow chart of the current testing logic which may be seen to start at current heating 416 and current cooling 418 as is shown on the overall flow chart in FIG. 2. Referring to the current heating sequence, the logic flows from step 416 to step 502 to set a trip level. The trip level is determined by multiplying the reference current level to the compressor motor in heating by 87.5%. The logic then flows to step 504 wherein the question of whether the signal is greater than the trip level is asked. If the answer to this step is no the logic proceeds to capacity increase. If the answer to the step is yes the logic flows on to step 506 to set up a reference level.

From logic step 506 the logic flows to step 508 to increase the reference level by 1. Thereafter, at logic step 510 the question is asked whether or not the reference level is legal. If the answer to this question is no the logic flows on to capacity increase 320. If the answer to the question at step 510 is yes, the logic flows to step 512 wherein a logic step of mod count −1 is provided. This step is to adjust the count in a mod counter. The mod counter is a device set up to accumulate counts. Herein it is set up to accumulate counts as an 8 bit counter in the heating mode and as a 16 bit counter in the cooling mode. Step 512 acts to decrement the counter by 1. At step 514 the logic asks whether the module count is set to zero. If the answer is no the current level or trip level is incremented by 1. If the answer is yes the logic proceeds to set the mod counter to maximum which is 16 in the heating mode. The logic then flows to step 520 to ask whether the unit is in the cooling mode of operation. If the answer is yes the logic flows immediately to capacity increase step 320. If the answer is no the logic flows to step 522 to increase the current level by two counts.

The current cooling logic is similar to the current heating. The logic flows from current cooling step 418 to step 540 of setting up the trip current level of the current for cooling which is determined by multiplying the reference level by 106.25%. The logic then flows from step 540 to step 542 where the question is asked whether or not the signal is less than trip level. If the answer is no the logic flows to capacity increase step 320. If the answer is yes the logic flows to step 544 to set the reference level at that level. From logic step 544 the logic flows to step 546 where the question is asked is the signal greater than the level. If the answer is yes the logic flows to capacity increase step 320. If the answer is no the logic flows to step 548 wherein the question is asked whether or not the reference level is legal. If the answer is no the logic again flows to capacity increase step 320. If the answer is yes at step 548 the logic flows to logic step 550 to decrement the reference level by 1. From step 550 the logic flows to step 552 where the mod count is additionally decremented by 1. The logic then flows to logic step 554 wherein the question of whether or not the mod count equals zero is asked. If the answer is no at step 554 the logic flows to step 558 to decrement the current level by 1. If the answer to the question at step 554 is yes the logic flows to step 556 to set the mod counter at maximum or 16 cooling. From there the logic flows to capacity increase step 320.

Hence, it can be seen that in current heating the reference level and the current level are both incremented by 1 except for every 8th count when the current level is incremented by 2. In current cooling it can be seen that the reference level and the mod count are both decremented by 1 except for every 16th count where the current level is not decremented. Hence, upon the logic flowing through the above sequence at predetermined time intervals, based upon the levels detected, the mod count will either stay consistent with the reference level or vary therefrom. The variance therefrom indicates a need to increase the capacity of the compressor.

Figure 6:
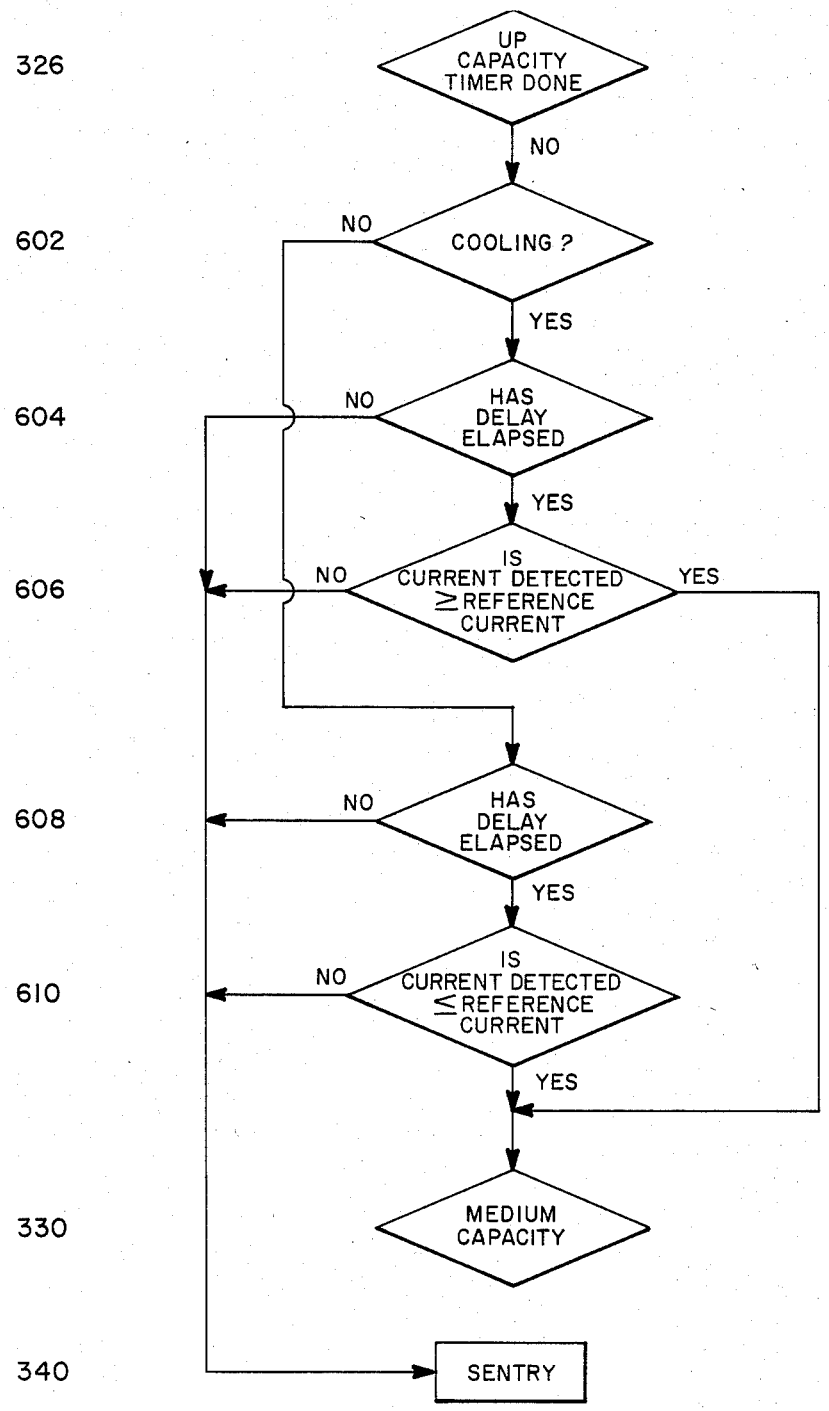
FIG. 6 is a flow chart of the increase in capacity logic using the current values obtained in the current testing subroutine.

Referring now to FIG. 6 there may be seen a short flow chart which is the equivalent of the current delay done step 328 as shown on FIG. 3. It then may be seen in FIG. 6 that the logic starts at step 326 on FIG. 3 and concludes at steps 330 and 340 of FIG. 3. At step 326 the question of whether or not the up capacity timer done is asked. If the answer is no the logic then flows to step 602 to ask whether or not the unit is in the cooling mode of operation. If the answer is yes, the logic flows to step 604 to ask whether or not the delay period between measuring the reference current level and the operating current level has elapsed. If the answer is yes, the logic flows to step 606 to ask whether or not the current detected is greater than or equal to the reference level. If the answer to this step is yes the logic then flows to step 330, medium capacity. If the answer to step 604 or 606 is no the logic flows to step 340, sentry. If the answer to step 602 is no, that the unit is not in the cooling mode, the logic then flows to step 608. At step 608 the question is asked whether or not the delay between the reference level being determined and the operating current being determined has elapsed. If the answer to this question is no the logic flows to step 340, sentry. If the answer to this question is yes the logic then flows to step 610 to ask whether or not the current level is less than or equal to of the reference current. If the answer to this step is yes the logic flows to step 330, medium capacity. If the answer to this step is no the logic then flows to step 340, sentry. Hence, it can be seen in FIG. 6 that the comparison of the current reference to the actual current is all conducted in the step labeled current delay done, 328 on FIG. 3. These comparisons are made to determine whether or not the logic should flow on to increase the capacity of the compressor in response to the variance in current level. If the answer is no at steps 604 or 606 or 608 or 610 then the logic flow is to sentry, step 340.

The invention has been described herein with reference to a particular embodiment. It is to be understood by those skilled in the art that variations and modifications can be effected within the spirit and scope of the invention.

What is claimed is:

1. A control for a refrigeration circuit including an outdoor heat exchanger, at least one indoor heat exchanger and an electric motor driven variable capacity compressor means which comprises:

current sensing means for sensing the current drawn by the motor driving the compressor;

logic means connected to the current sensing means for storing the value of the current flow detected by the current sensing means as a reference value;

comparator means for comparing the value of the current flow to the compressor motor after a delay interval to the value of current flow stored in the logic means, said comparator means generating an increase signal when a selected one of said values exceeds the other of said values; and means for increasing the capacity of the compressor in response to the detection of an increase signal.

2. The apparatus as set forth in claim 1 wherein the logic means further comprises calculation means for multiplying the value of the current flow detected by the current sensing means by a variance factor such that the comparator means compares the value of the current flow to the compressor motor with the product of the current flow detected by the current sensing means and the variance factor.

3. The apparatus as set forth in claim 2 wherein the refrigeration circuit is a reversible refrigeration circuit and wherein when the refrigeration circuit is operated in the cooling mode of operation the reference value shall be decreased if the current sensed decreased from the original reference value but shall not be increased if the current sensed increases by the original reference value.

4. The apparatus as set forth in claim 3 wherein the variance factor is approximately 106.25%.

5. The apparatus as set forth in claim 2 wherein the refrigeration circuit is a reversible refrigeration circuit and wherein when the refrigeration circuit is operated in the heating mode of operation the reference value shall be increased if the current sensed increases from the original reference level but shall not be decreased if the value of the current sensed decreases from the original reference value.

6. The apparatus as set forth in claim 5 wherein the variance factor is approximately 87.5%.

7. The apparatus as set forth in claim 1 and further including:

means for generating an increase signal upon the elapse of a preselected delay interval during which the compressor motor is continuously energized and the capacity step of the compressor has not been changed.

8. The apparatus as set forth in claim 1 and further including:

means for generating an increase signal in response to an additional indoor heat exchanger being energized.

9. A method of determining when to increase the capacity of an electric motor driven variable capacity compressor of a refrigeration circuit having at least one indoor heat exchanger which comprises the steps of:

sensing the steady state current draw of the compressor motor during operation of the refrigeration circuit as a reference value;

determining the current draw of the compressor motor during subsequent operation of the refrigeration circuit; and initiating a signal to increase the capacity of the compressor when the step of determining ascertains a value of the current draw which varies from the reference value of the current draw by a predetermined factor.

10. The method as set forth in claim 9 wherein the step of initiating further comprises:

multiplying the reference current value by a predetermined value to obtain an adjusted reference value; and comparing the adjusted reference value to the current value ascertained by the step of determining.

11. The method as set forth in claim 9 wherein the refrigeration circuit is a reversible refrigeration circuit and when said circuit is operated in the heating mode of operation further comprising the steps of increasing the reference value ascertained by the step of sensing if the step of determining ascertains a larger current value than the reference value; and wherein the step of initiating further comprises initiating a signal when the current value ascertained by the step of determining is less than the updated reference value multiplied by the predetermined factor.

12. The method as set forth in claim 9 wherein the refrigeration circuit is a reversible refrigeration circuit and when said circuit is operated in the cooling mode of operation and further comprising the steps of decreasing the reference value ascertained by the step of sensing if the step of determining ascertains a lesser current value than the reference value; and wherein the step of initiating further comprises initiating a signal when the current value ascertained by the step of determining is greater than the updated reference value multiplied by the predetermined factor.

13. The method as set forth in claim 9 and further comprising the additional steps of:

monitoring the length of time the compressor operates at a selected capacity step; and generating a signal to increase the capacity of the compressor upon the step of monitoring determining continuous operation for a predetermined time period.

14. The method as set forth in claim 11 and further comprising the additional step of providing a signal to increase the capacity of the compressor upon additional heat exchangers becoming active.

* * * * *